US011384470B2

(12) United States Patent
Borlin

(10) Patent No.: US 11,384,470 B2
(45) Date of Patent: Jul. 12, 2022

(54) LAUNDRY TREATING APPLIANCE WITH TUNED SUSPENSION SYSTEM

(71) Applicant: WHIRLPOOL CORPORATION, Benton Harbor, MI (US)

(72) Inventor: Christopher Borlin, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 66 days.

(21) Appl. No.: 17/071,214

(22) Filed: Oct. 15, 2020

(65) Prior Publication Data

US 2021/0025096 A1 Jan. 28, 2021

Related U.S. Application Data

(60) Continuation of application No. 16/055,781, filed on Aug. 6, 2018, now Pat. No. 10,815,599, which is a division of application No. 15/047,075, filed on Feb. 18, 2016, now Pat. No. 10,100,453.

(51) Int. Cl.

| | |
|---|---|
| ***D06F 37/22*** | (2006.01) |
| ***D06F 37/26*** | (2006.01) |
| ***D06F 33/48*** | (2020.01) |
| ***D06F 37/02*** | (2006.01) |
| ***D06F 103/26*** | (2020.01) |
| ***D06F 34/16*** | (2020.01) |
| ***D06F 103/04*** | (2020.01) |
| ***D06F 105/48*** | (2020.01) |
| ***D06F 34/18*** | (2020.01) |
| ***D06F 37/36*** | (2006.01) |

(52) U.S. Cl.

CPC ..... *D06F 37/22* (2013.01); *D06F 33/48* (2020.02); *D06F 37/268* (2013.01); *D06F 37/36* (2013.01); *D06F 34/16* (2020.02); *D06F 34/18* (2020.02); *D06F 37/02* (2013.01); *D06F 2103/04* (2020.02); *D06F 2103/26* (2020.02); *D06F 2105/48* (2020.02)

(58) Field of Classification Search

CPC ..... D06F 33/48; D06F 34/16; D06F 34/18; D06F 37/02; D06F 37/22; D06F 37/268; D06F 2103/04; D06F 2103/26; D06F 2105/48

See application file for complete search history.

(56) References Cited

U.S. PATENT DOCUMENTS

| | | | |
|---|---|---|---|
| 3,114,705 | A | 12/1963 | Pribonic et al. |
| 5,101,645 | A | 4/1992 | Malchow |
| 6,546,354 | B1 | 4/2003 | Gayme |
| 6,647,575 | B2 | 11/2003 | Garstecki et al. |
| 8,196,441 | B2 | 6/2012 | Hendrickson et al. |

(Continued)

FOREIGN PATENT DOCUMENTS

| | | | |
|---|---|---|---|
| EP | 1167612 | A2 | 1/2002 |

*Primary Examiner* — Joseph L. Perrin

(74) *Attorney, Agent, or Firm* — McGarry Bair PC

(57) ABSTRACT

An apparatus and method for reducing displacement of a washing machine having a drum rotatable about an axis of rotation is disclosed. The washing machine comprises a chassis and a motor for rotation a drum. The drum is suspended from the chassis by a suspension. The suspension can comprise springs having six natural frequencies that can resonate at a rotational speed of the drum driven by the motor. The suspension system can be tuned such that resonant frequencies can be varied based upon rotational speed of the drum.

20 Claims, 8 Drawing Sheets

(56) References Cited

U.S. PATENT DOCUMENTS

| | | | |
|---|---|---|---|
| 8,388,695 | B2 | 3/2013 | Hendrickson et al. |
| 8,397,328 | B2 | 3/2013 | Hendrickson et al. |
| 8,397,544 | B2 | 3/2013 | Hendrickson |
| 8,438,881 | B2 | 5/2013 | Ihne et al. |
| 8,813,526 | B2 | 8/2014 | Doyle et al. |
| 2002/0000010 | A1 | 1/2002 | Garstecki et al. |
| 2009/0151398 | A1 | 6/2009 | Fang et al. |
| 2010/0000264 | A1 | 1/2010 | Luckman et al. |
| 2010/0186317 | A1 | 7/2010 | Kirsten et al. |
| 2011/0047715 | A1 | 3/2011 | Kim et al. |
| 2012/0017645 | A1 | 1/2012 | Baron |

LAUNDRY TREATING APPLIANCE WITH TUNED SUSPENSION SYSTEM

CROSS REFERENCE TO RELATED APPLICATIONS

This application is a continuation of U.S. patent application Ser. No. 16/055,781, filed Aug. 6, 2018, now U.S. Pat. No. 10,815,599, issued Oct. 27, 2020, which is a divisional of U.S. patent application Ser. No. 15/047,075, filed Feb. 18, 2016, now U.S. Pat. No. 10,100,453, issued on Oct. 16, 2018, all of which are hereby incorporated by reference in their entirety.

BACKGROUND

Laundry treating appliances, such as clothes washers, refreshers, and non-aqueous systems, can have a configuration based on a cabinet within which is housed the components of the appliance, including a liquid container, typically in the form of a tub. The tub typically houses a laundry container defining a treating chamber in which laundry items are placed for treating. The tub is dimensioned to accommodate tub movement within the cabinet, movement of the laundry container within the tub, and to support forces generated by the weight and rotation of the laundry container.

A suspension system typically connects the tub to the cabinet to support the movement of the tub and the laundry container within the cabinet, dampening any movement or vibrational transmission from the tub or the laundry container therein. Supporting the movement of the tub within the cabinet limits the capacity of the tub, thus limiting the capacity of the laundry container within the tub and the volume of the treating chamber directly limiting the volume of laundry that can be treated within the treating chamber.

BRIEF DESCRIPTION

An aspect of the present disclosure relates to a laundry treating appliance, comprising a structural support system, a laundry holding system disposed within the structural support system, the laundry holding system including a rotatable treating chamber, a motor operably coupled to the rotatable treating chamber, a suspension system operably coupled to at least a portion of the laundry holding system and suspending the laundry holding system within the structural support system, the suspension system having six natural frequencies including three translational frequencies and three rotational frequencies, the suspension system includes at least one spring that is configured to group the three translational frequencies and three rotational frequencies into a first group determined by a predetermined first rotational speed range of the rotatable treating chamber or the motor and a second group determined by a predetermined second rotational speed range of the rotatable treating chamber or the motor that is separated from the predetermined first rotational speed range, in this manner the first group and the second group are correlated to known speeds that can be accelerated through during a cycle of operation; and a controller configured to accelerate the rotatable treating chamber, via the motor, to a rotational speed between the first group and the second group.

DETAILED DESCRIPTION

Figure 1:
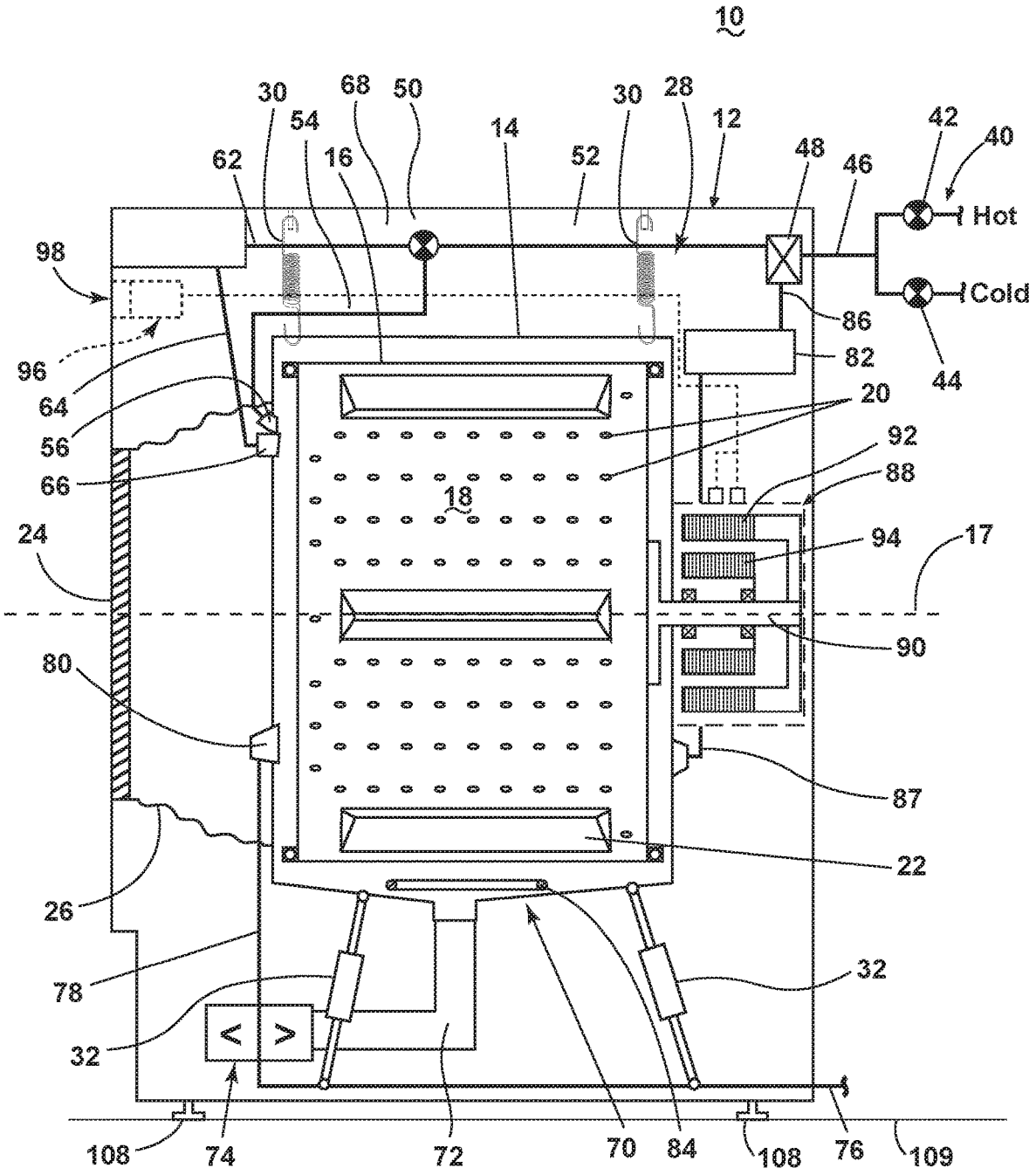
FIG. 1 is a schematic view of a laundry treating appliance in the form of a washing machine.

FIG. 1 is a schematic view of a laundry treating appliance according to a first illustrative embodiment in accordance with the present disclosure. The laundry treating appliance can be any appliance which performs a cycle of operation to clean or otherwise treat items placed therein, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine. Laundry treating appliances can have a configuration based on a rotating container that defines a treating chamber in which laundry items are placed for treating. In a vertical axis washing machine, the container is in the form of a perforated basket located within a tub; both the basket and tub typically have an upper opening at their respective upper ends. In a horizontal axis washing machine, the container is in the form of a perforated drum located within a tub; both the drum and tub typically have an opening at their respective front facing ends.

The laundry treating appliance of FIG. 1 is illustrated as a washing machine 10 and more specifically as a horizontal axis washing machine. A structural support system including a chassis 12 can be includes and defines a housing within which a laundry holding system resides. The chassis 12 can be a housing having a cabinet and/or a frame, defining an interior enclosing components typically found in a conventional washing machine, such as motors, pumps, fluid lines, controls, sensors, transducers, and the like. Such components will not be described further herein except as necessary for a complete understanding of illustrative embodiments in accordance with the present disclosure.

The laundry holding system includes a tub 14 and a drum 16 provided within the tub 14. The drum 16 is rotatable about an axis of rotation 17 and defines at least a portion of a treating chamber 18. The drum 16 can include a plurality of perforations 20 such that liquid can flow between the tub 14 and the drum 16 through the perforations 20. A plurality of baffles 22 can be disposed on an inner surface of the drum 16 to lift the laundry load received in the treating chamber 18 while the drum 16 rotates. It is also within the scope of the present disclosure for the laundry holding system to include only a tub with the tub defining the laundry treating chamber.

The laundry holding system can further include a door 24, which can be movably mounted to the chassis 12 to selectively close both the tub 14 and the drum 16. A bellows 26 can couple an open face of the tub 14 with the chassis 12, with the door 24 sealing against the bellows 26 when the door 24 closes the tub 14.

The washing machine 10 includes a suspension system 28 for dynamically suspending the laundry holding system within the structural support system. More specifically the tub 14 is supported within the chassis 12 by suspension system 28. The suspension system 28 can include multiple springs 30 suspending the tub 14 from the upper area of the chassis 12, while multiple struts 32 can be used to support the system from below. Preferably, three or more springs 30 are utilized to suspend the laundry holding system.

The washing machine 10 can further include a liquid supply system for supplying water to the washing machine 10 for use in treating laundry during a cycle of operation. The liquid supply system can include a source of water, such as a household water supply 40, which can include separate valves 42 and 44 for controlling the flow of hot and cold water, respectively. Water can be supplied through an inlet conduit 46 directly to the tub 14 by controlling first and second diverter mechanisms 48 and 50, respectively. The diverter mechanisms 48, 50 can be a diverter valve having two outlets such that the diverter mechanisms 48, 50 can selectively direct a flow of liquid to one or both of two flow paths. Water from the household water supply 40 can flow through the inlet conduit 46 to the first diverter mechanism 48 which can direct the flow of liquid to a supply conduit 52. The second diverter mechanism 50 on the supply conduit 52 can direct the flow of liquid to a tub outlet conduit 54 which can be provided with a spray nozzle 56 configured to spray the flow of liquid into the tub 14. In this manner, water from the household water supply 40 can be supplied directly to the tub 14.

The washing machine 10 can also be provided with a dispensing system for dispensing treating chemistry to the treating chamber 18 for use in treating the laundry according to a cycle of operation. The dispensing system can include a dispenser 62 which can be a single use dispenser, a bulk dispenser or a combination of a single and bulk dispenser. Non-limiting examples of suitable dispensers are disclosed in U.S. Pub. No. 2010/0000022 to Hendrickson et al., filed Jul. 1, 2008, now U.S. Pat. No. 8,196,441, issued Jun. 12, 2012, entitled "Household Cleaning Appliance with a Dispensing System Operable Between a Single Use Dispensing System and a Bulk Dispensing System," U.S. Pub. No. 2010/0000024 to Hendrickson et al., filed Jul. 1, 2008, now U.S. Pat. No. 8,388,695, issued Mar. 5, 2013, entitled "Apparatus and Method for Controlling Laundering Cycle by Sensing Wash Aid Concentration," U.S. Pub. No. 2010/0000573 to Hendrickson et al., filed Jul. 1, 2008, now U.S. Pat. No. 8,397,328, issued Mar. 19, 2013, entitled "Apparatus and Method for Controlling Concentration of Wash Aid in Wash Liquid," U.S. Pub. No. 2010/0000581 to Doyle et al., filed Jul. 1, 2008, now U.S. Pat. No. 8,813,526, issued Aug. 26, 2014, entitled "Water Flow Paths in a Household Cleaning Appliance with Single Use and Bulk Dispensing," U.S. Pub. No. 2010/0000264 to Luckman et al., filed Jul. 1, 2008, now abandoned, entitled "Method for Converting a Household Cleaning Appliance with a Non-Bulk Dispensing System to a Household Cleaning Appliance with a Bulk Dispensing System," U.S. Pub. No. 2010/0000586 to Hendrickson, filed Jun. 23, 2009, now U.S. Pat. No. 8,397,544, issued Mar. 19, 2013, entitled "Household Cleaning Appliance with a Single Water Flow Path for Both Non-Bulk and Bulk Dispensing," and application Ser. No. 13/093,132, filed Apr. 25, 2011, now U.S. Pat. No. 8,438,881, issued May 4, 2013, entitled "Method and Apparatus for Dispensing Treating Chemistry in a Laundry Treating Appliance," which are herein incorporated by reference in full.

Regardless of the type of dispenser used, the dispenser 62 can be configured to dispense a treating chemistry directly to the tub 14 or mixed with water from the liquid supply system through a dispensing outlet conduit 64. The dispensing outlet conduit 64 can include a dispensing nozzle 66 configured to dispense the treating chemistry into the tub 14 in a desired pattern and under a desired amount of pressure. For example, the dispensing nozzle 66 can be configured to dispense a flow or stream of treating chemistry into the tub 14 by gravity, i.e. a non-pressurized stream. Water can be supplied to the dispenser 62 from the supply conduit 52 by directing the diverter mechanism 50 to direct the flow of water to a dispensing supply conduit 68.

Non-limiting examples of treating chemistries that can be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The washing machine 10 can also include a recirculation and drain system for recirculating liquid within the laundry holding system and draining liquid from the washing machine 10. Liquid supplied to the tub 14 through tub outlet conduit 54 and/or the dispensing supply conduit 68 typically enters a space between the tub 14 and the drum 16 and can flow by gravity to a sump 70 formed in part by a lower portion of the tub 14. The sump 70 can also be formed by a sump conduit 72 that can fluidly couple the lower portion of the tub 14 to a pump 74. The pump 74 can direct liquid to a drain conduit 76, which can drain the liquid from the washing machine 10, or to a recirculation conduit 78, which can terminate at a recirculation inlet 80. The recirculation inlet 80 can direct the liquid from the recirculation conduit 78 into the drum 16. The recirculation inlet 80 can introduce the liquid into the drum 16 in any suitable manner, such as by spraying, dripping, or providing a steady flow of liquid. In this manner, liquid provided to the tub 14, with or without treating chemistry can be recirculated into the treating chamber 18 for treating the laundry within.

The liquid supply and/or recirculation and drain system can be provided with a heating system which can include one or more devices for heating laundry and/or liquid supplied to the tub 14, such as a steam generator 82 and/or a sump heater 84. Liquid from the household water supply 40 can be provided to the steam generator 82 through the inlet conduit 46 by controlling the first diverter mechanism 48 to direct the flow of liquid to a steam supply conduit 86. Steam generated by the steam generator 82 can be supplied to the tub 14 through a steam outlet conduit 87. The steam generator 82 can be any suitable type of steam generator such as a flow through steam generator or a tank-type steam generator. Alternatively, the sump heater 84 can be used to generate steam in place of or in addition to the steam generator 82. In addition or alternatively to generating steam, the steam generator 82 and/or sump heater 84 can be used to heat the laundry and/or liquid within the tub 14 as part of a cycle of operation.

Additionally, the liquid supply and recirculation and drain system can differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 also includes a drive system for rotating the drum 16 within the tub 14. The drive system can include a motor 88, which can be directly coupled with the drum 16 through a drive shaft 90 to rotate the drum 16 about a rotational axis during a cycle of operation. The motor 88 can be a brushless permanent magnet (BPM) motor having a stator 92 and a rotor 94. Alternately, the motor 88 can be coupled to the drum 16 through a belt and a drive shaft to rotate the drum 16, as is known in the art. Other motors, such as an induction motor or a permanent split capacitor (PSC) motor, can also be used. The motor 88 can rotate the drum 16 at various speeds in either rotational direction.

The washing machine 10 also includes a control system for controlling the operation of the washing machine 10 to implement one or more cycles of operation. The control system can include a controller 96 located within the chassis 12 and a user interface 98 that is operably coupled with the controller 96. The user interface 98 can include one or more knobs, dials, switches, displays, touch screens, and the like for communicating with the user, such as to receive input and provide output. The user can enter different types of information including, without limitation, cycle selection and cycle parameters, such as cycle options.

The controller 96 can include the machine controller and any additional controllers provided for controlling any of the components of the washing machine 10. For example, the controller 96 can include the machine controller and a motor controller. Many known types of controllers can be used for the controller 96. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

Figure 2:
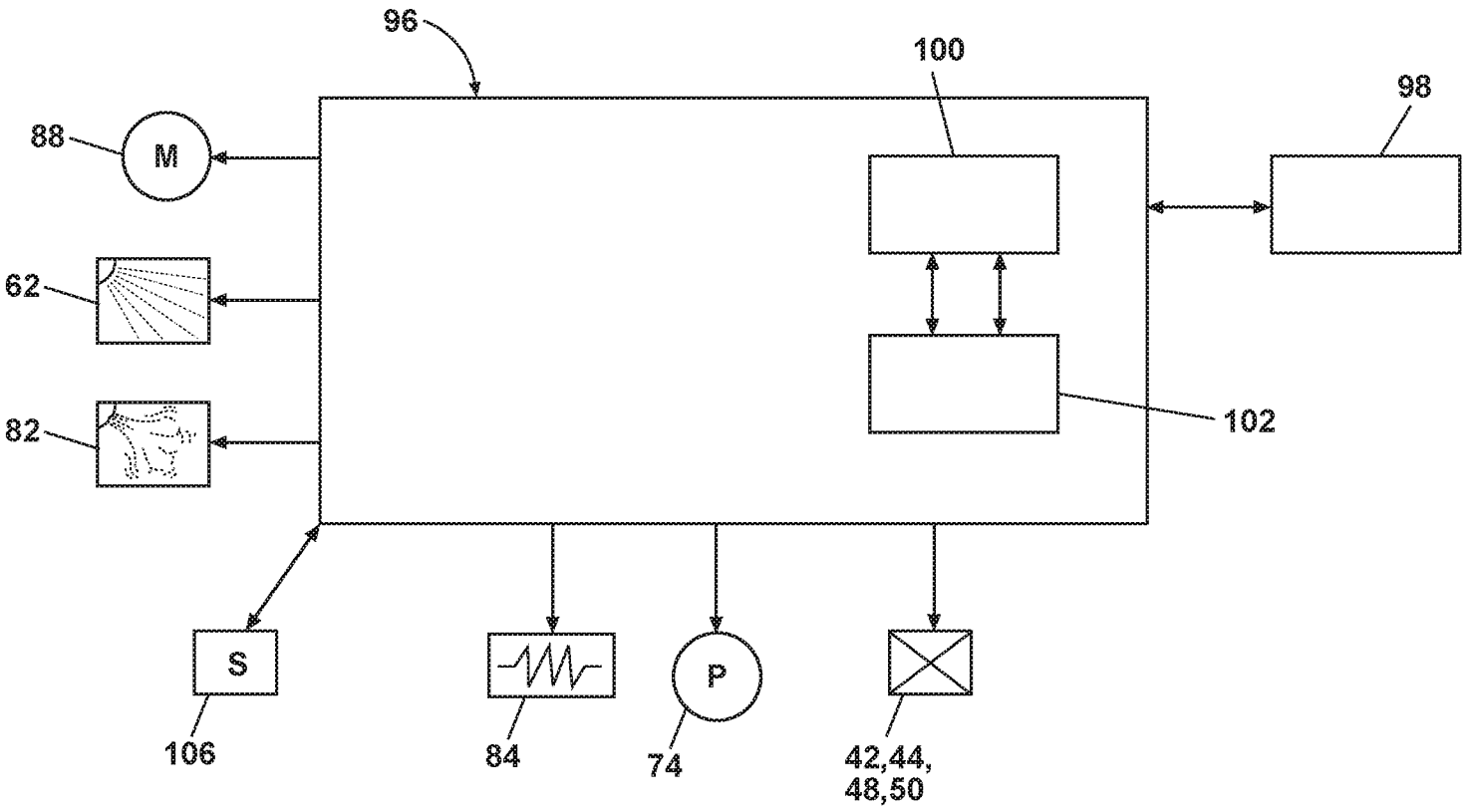
FIG. 2 is a schematic of a control system of the laundry treating appliance of FIG. 1.

As illustrated in FIG. 2, the controller 96 can be provided with a memory 100 and a central processing unit (CPU) 102. The memory 100 can be used for storing the control software that is executed by the CPU 102 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 100 can also be used to store information, such as a database or table, and to store data received from one or more components of the washing machine 10 that can be communicably coupled with the controller 96. The database or table can be used to store the various operating parameters for the one or more cycles of operation, including factory default values for the operating parameters and any adjustments to them by the control system or by user input.

The controller 96 can be operably coupled with one or more components of the washing machine 10 for communicating with and controlling the operation of the component to complete a cycle of operation. For example, the controller 96 can be operably coupled with the motor 88, the pump 74, the dispenser 62, the steam generator 82 and the sump heater 84 to control the operation of these and other components to implement one or more of the cycles of operation.

The controller 96 can also be coupled with one or more sensors 106 provided in one or more of the systems of the washing machine 10 to receive input from the sensors, which are known in the art and not shown for simplicity. Non-limiting examples of sensors 106 that can be communicably coupled with the controller 96 include: a treating chamber temperature sensor, a moisture sensor, a weight sensor, a chemical sensor, a position sensor and a motor torque sensor, which can be used to determine a variety of system and laundry characteristics, such as laundry load inertia or mass.

In one example, one or more load amount sensors 106 can also be included in the washing machine 10 and can be positioned in any suitable location for detecting the amount of laundry, either quantitative (inertia, mass, weight, etc.) or qualitative (small, medium, large, etc.) within the treating chamber 18. By way of non-limiting example, it is contemplated that the amount of laundry in the treating chamber can be determined based on the weight of the laundry and/or the volume of laundry in the treating chamber. Thus, the one or more load amount sensors 106 can output a signal indicative of either the weight of the laundry load in the treating chamber 18 or the volume of the laundry load in the treating chamber 18.

The one or more load amount sensors 106 can be any suitable type of sensor capable of measuring the weight or volume of laundry in the treating chamber 18. Non-limiting examples of load amount sensors 106 for measuring the weight of the laundry can include load volume, pressure, or force transducers which can include, for example, load cells and strain gauges. It has been contemplated that the one or more such sensors 106 can be operably coupled to the suspension system 28 to sense the weight borne by the suspension system 28. The weight borne by the suspension system 28 correlates to the weight of the laundry loaded into the treating chamber 18 such that the sensor 106 can indicate the weight of the laundry loaded in the treating chamber 18. In the case of a suitable sensor 106 for determining volume it is contemplated that an IR or optical based sensor can be used to determine the volume of laundry located in the treating chamber 18.

Alternatively, it has been contemplated that the washing machine 10 can have one or more pairs of feet 108 (FIG. 1) extending from the chassis 12 and supporting the chassis 12 on a surface 109 such as a floor and that a weight sensor (not shown) can be operably coupled to at least one of the feet 108 to sense the weight borne by that foot 108, which correlates to the weight of the laundry loaded into the treating chamber 18. In another example, the amount of laundry within the treating chamber 18 can be determined based on motor sensor output, such as output from a motor torque sensor. The motor torque is a function of the inertia of the rotating drum and laundry. There are many known methods for determining the load inertia, and thus the load mass, based on the motor torque. It will be understood that any suitable method and sensors can be used to determine the amount of laundry.

Figure 3:
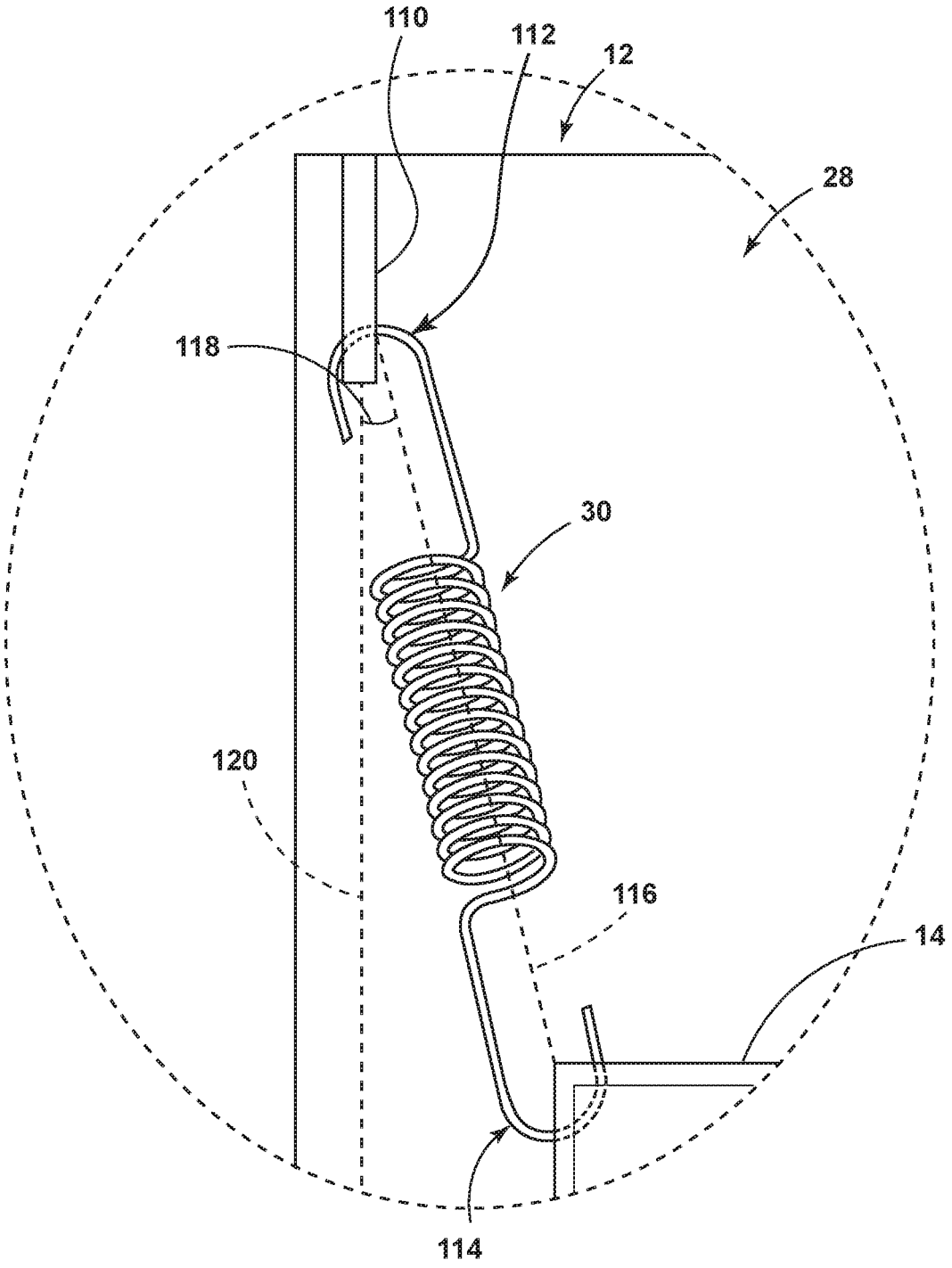
FIG. 3 is a schematic view illustrating a portion of a suspension system of the laundry treating appliance of FIG. 1.

Referring now to FIG. 3, one spring 30 of the suspension system 28 is shown as mounting the tub 14 to the chassis 12. More specifically, an extension 110 extends from the chassis 12 and a first end 112 of the spring 30 mounts to the extension 110 of the chassis 12. An opposing end 114 of the spring 30 couples to the tub 14 and thus mounts the tub 14 form the chassis 12. The spring 30 can define a longitudinal spring axis 116 along the length of the spring 30. The spring 30 can be disposed at an angle 118 defined by the longitudinal spring axis 116 relative to a vertical axis 120 orthogonal to the surface 109 on which the washing machine 10 rests. More specifically, the tub 14 and chassis 12 can be designed to arrange the springs 30 at the particular angle 118 when suspending the tub 14. It should be appreciated that while only one spring 30 is shown a set of springs can be utilized. A 'set' as used herein can include three or more springs 30, and should not be limited to the examples as described. For example, four springs 30 can be utilized and can suspend the tub 14 from each corner of the chassis 12.

Further, the springs 30 can have particular spring stiffness. The stiffness of the spring 30 is the rigidity of the spring 30 or the resistance to deformation the spring 30 has. The stiffness, or spring constant, (k) is the ratio of force (F) to displacement (δ) produced by the force, such that the stiffness can be defined as $$k=F/\delta. \quad (1)$$

The spring(s) 30 can also define six suspension natural frequencies for movement of the tub 14 about the suspension system 28. The term "natural frequency" as used herein is the frequency at which a system, such as the suspension system 28, tends to oscillate in the absence of any driving or damping force(s) and at which the system can resonate if held at that frequency. The six natural frequencies can include, but are not limited to, three rotational frequencies and three translational frequencies. The three rotational frequencies and three translational frequencies relate to rotational and linear oscillating movement, respectively, of the drum 16 in three-dimensional space during operation of the washing machine 10. A horizontal axis passing side-to-side through the washing machine 10 can be defined as an X-axis, a horizontal axis that is perpendicular to the X-axis and passes front-to-back through the washing machine 10 can be defined as a Z-axis, and a vertical axis of the washing machine 10 can be the Y-axis. The Z-axis lies generally parallel to the rotational axis of the drum 16. The rotational frequencies can be rotational movement about any of these axes. For the horizontal axis washing machine, three translational degrees of freedom can lie in the X-axis, Y-axis and the Z-axis translational movements. The translational movements can be linear displacement of the drum 16 along the axes as opposed to the rotational movements about the rotational degrees of freedom.

During operation of the washing machine 10, the six natural frequencies will be passed through during acceleration of the drum 16 through various rotational speeds of the drum 16 defined as rotations per minute (rpm). The rotations per minute can be representative of a motor speed driving the drum 16 at a particular number of rotations per minute. During the acceleration, a moment occurs where the drum 16 reaches a rotational speed that coincides with a particular natural frequency of the suspension system 28. The drum 16 will resonate with the suspension system 28 at a particular rotational speed of the drum 16, causing increasing rotational or translational vibrations, and displacement of the drum 16. At such a moment, the vibration of the suspension system 28 causes oscillations and resonance, which causes tub 14 displacement, which can lead to contact between the tub 14 and the drum 16, or the tub 14 and the chassis 12, as well as washing machine 'walking.' Washing machine 'walking,' as understood in the art, occurs when the resonance of the tub 14 causes the washing machine 10 to move from its initial position on the surface 109 upon which it rests.

In order to avoid excessive tub 14 displacement, it is preferable to tune the suspension system 28 to group the natural frequencies into ranges. More specifically, the springs 30 can be "tuned" such that the natural frequencies are changed. The natural frequencies can be tuned to correspond to a different rotational speed of the drum 16 or motor 88 and in this manner, the grouping of the frequencies can be facilitated. Tuning can be accomplished by changing the spring angle 118 or the stiffness of the springs 30. Additionally, tuning can be accomplished by changing the location or orientation of the springs 30, utilizing more or less springs, or using a counterweight mass and positioning such a counterweight. Upon grouping the natural frequencies, the drum 16 can be accelerated through the rotational speeds in which the frequencies are grouped, avoiding the issues associated with operation at those rotational speeds, such as the tub-chassis contact, etc. Put another way, the suspension system 28 can be tuned such that the natural frequencies are grouped within set rotational speeds and the drum 16 can be quickly accelerated through such rotational speeds so adverse movement is avoided.

Figure 4:
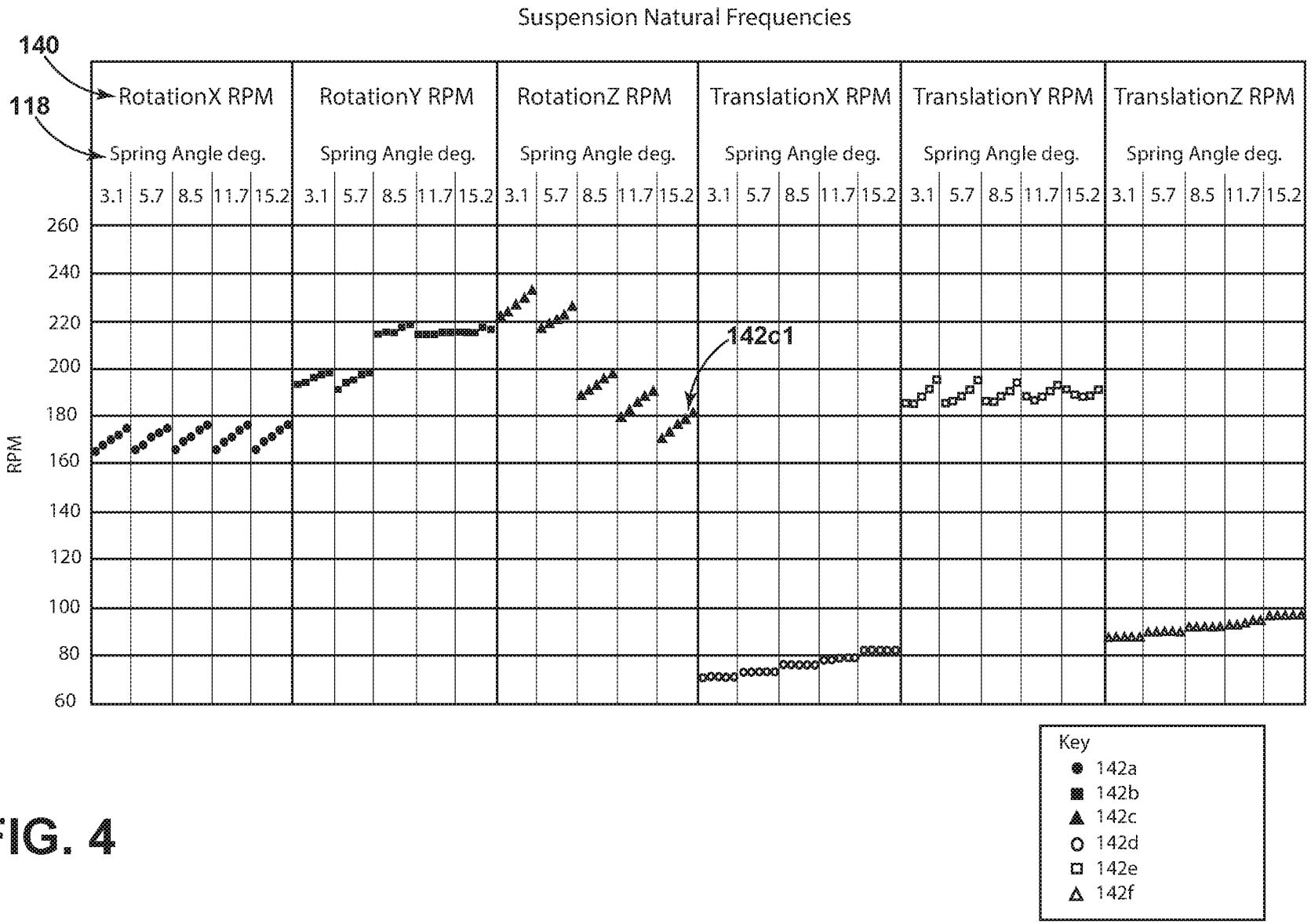
FIG. 4 is a plot illustrating suspension natural frequencies for six natural frequencies.

FIG. 4 illustrates an exemplary plot of for the six natural frequencies 140 based upon rotational speeds of the drum 16. Each natural frequency 140 includes five point sets 142*a-f*, with each point set 142*a-f* having five points. Each point set 142*a-f* has a separate spring angle 118 for the spring 30, being illustrated as angles of 3.1 degrees, 5.7 degrees, 8.5 degrees, 11.7 degrees, and 15.2 degrees. Within each point set 142*a-f*, five points represent five different spring stiffnesses, being 5.0, 5.2, 5.5, 5.7, and 6.0 Newtons per millimeter (k) from left to right. For example, looking at point set 142*c*1, from left to right, the stiffnesses can be 5.0, 5.2, 5.5, 5.7, and 6.0 at about 170, 172, 177, 179, and 181 rpm, respectively.

Varying the spring angle or stiffness can vary the rotational speed at which the natural frequency occurs. For example, by varying the angle for the springs 30 in the suspension system 28, the natural frequency can be varied as shown in FIG. 4. For the 'RotationX' rotational frequency 142*a*, varying the spring angle 118 will only vary the natural frequency by about 1 rpm. For the 'RotationY' rotational frequency 142*b*, varying the spring angle 118 can vary the natural frequency between about 190 rpm and 220 rpm. For the 'RotationZ' rotational frequency 142*c*, varying the spring angle 118 can vary the natural frequency between about 235 rpm and 170 rpm. For the 'TranslationX' translational frequency 142*d*, varying the spring angle 118 can vary the natural frequency between about 70 rpm and 82 rpm. For the 'TranslationY' translational frequency 142*e*, varying the spring angle 118 only changes the frequency change resultant from changing the stiffness, but does not change the natural frequency based upon the spring angle 118. For the 'TranslationZ' translational frequency 142*f*, varying the spring angle 118 can vary the natural frequency between about 86 and 100 rpm.

While changing the spring angle 118 can be used to vary the natural frequency, some natural frequencies are substantially unchanged by varying the spring angle 118. In order to change the natural frequency without modifying the spring angles 118, the spring stiffnesses can be varied. Looking at the 'RotationX' rotational frequency 142*a* in particular, increasing the spring stiffness by a value of between 0.5-1.0 Newtons per millimeter (k) can change the rotational speed by about 6-12 rpm at which the natural frequency occurs. Therefore, utilizing the spring angle 118 and the spring stiffness, the natural frequencies can be tuned such that groups can be defined based upon the rotational speed of the drum 16 or motor 88.

Figure 5:
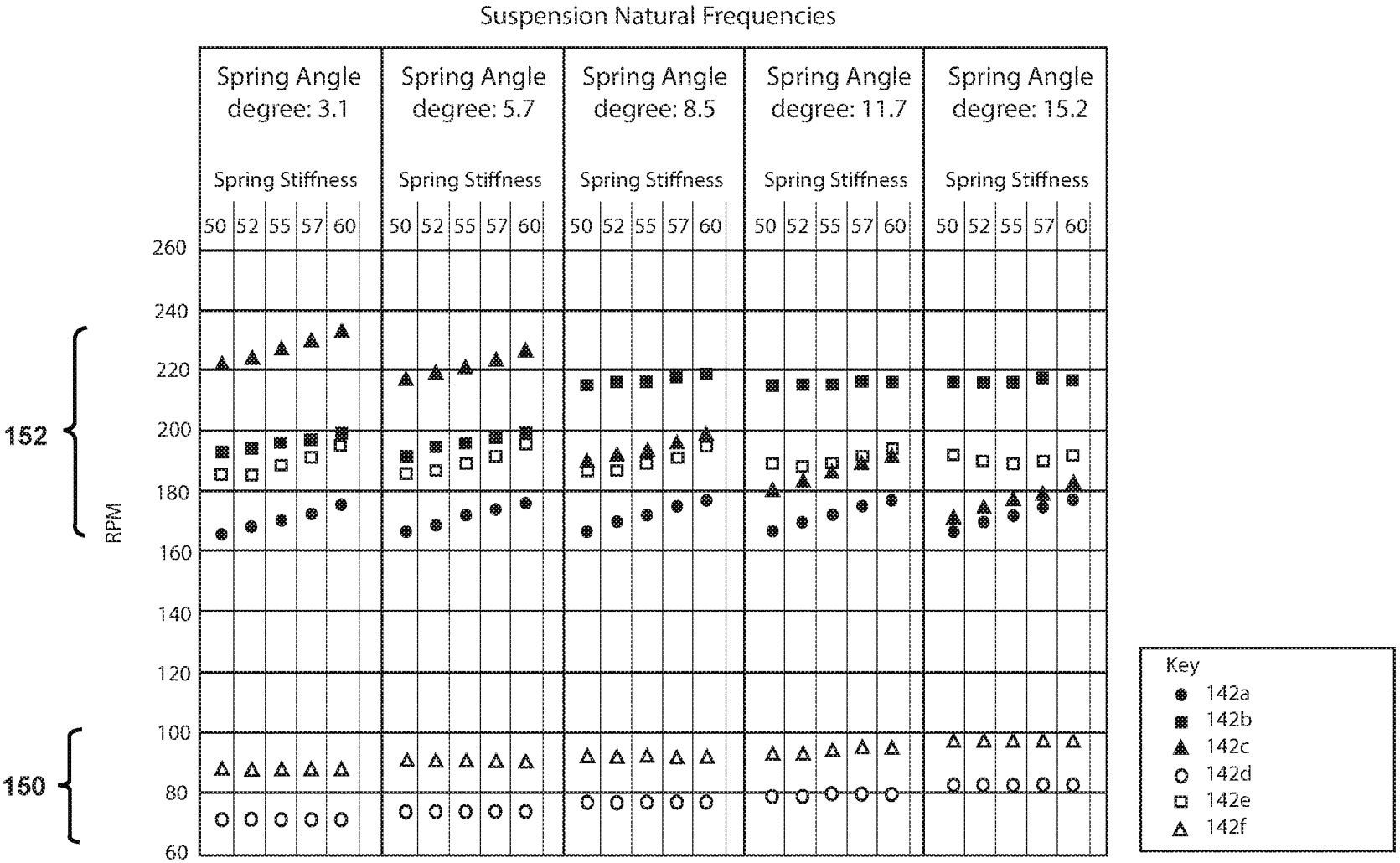
FIG. 5 is a plot illustrating the six natural frequencies for the suspension defining two groups.

Looking now at the plot illustrated in FIG. 5, the natural frequencies have been organized into groups including a first group 150 and a second group 152. The first group 150 and the second group 152 are defined based upon the rotational speed of the drum 16 at which the natural frequency occurs. The first group 150 can include two translational frequencies, such as the 'TranslationX' 142*d* and 'TranslationZ' 142*f* translational frequencies, and the second group 152 can include four natural frequencies, such as the three rotational frequencies and the 'TranslationY' translational frequency 142*e*. The first group 150 can be tuned between 70-95 rpm and the second group 152 can be tuned between 160-220 rpm. Greater ranges for the groups are contemplated.

It is contemplated that the six natural frequencies can be grouped in any manner, having any number of frequencies in any group, each group having at least one frequency. For example, the spring angle 118 and the stiffness can be varied to minimize the rotational range that the two group covers. By way of non-limiting example, utilizing a spring angle of 15.2-degrees and a spring stiffness of 60 would group the second group 152 into a range between about 170-220 rpm. At those values, the first group has a rotational speed range of about 70-95 rpm. At least a value of 70 rpm can separate the first group 150 and the second group 152 and in that specific example a separation of 80 rpm can be realized.

Figure 6:
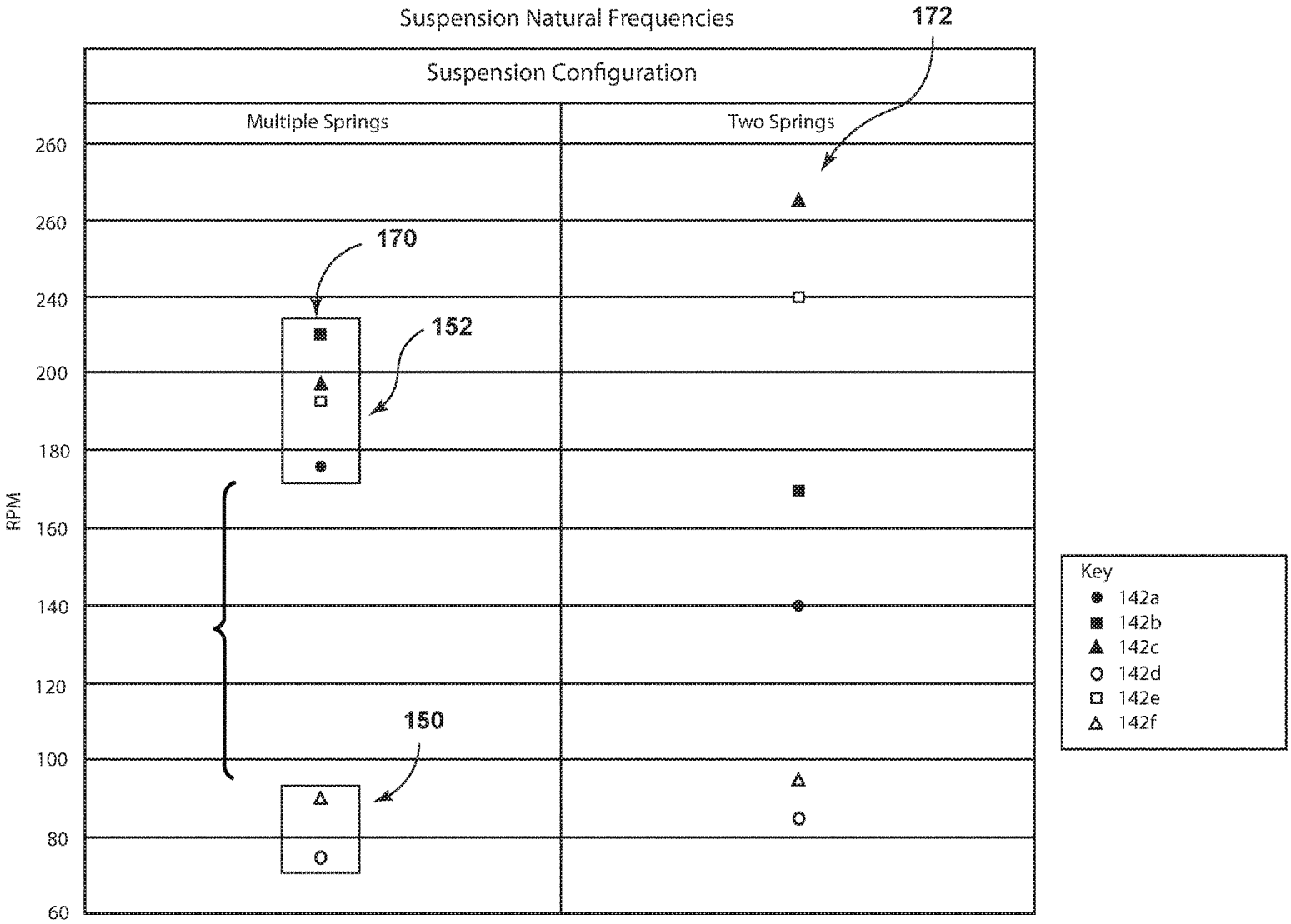
FIG. 6 is a plot illustrating the grouped natural frequencies as compared to two springs.

Turning now to FIG. 6, another plot illustrates the natural frequencies achieved with the use of multiple springs 170, where the term "multiple springs" defines a set of springs greater than two, against the natural frequencies achieved with the use of two springs 172. It will be understood that the use of two springs 172 at the top of the tub 14 in the middle are common with laundry treating appliances. The natural frequencies achieved with the multiple springs 170 provide for increased variability, i.e. having more springs 30 provides more opportunity to adjust the spring angle 118 or the spring stiffness to change the natural frequencies. The use of just two springs 172 provides little opportunity to tune the frequencies of the springs creating a broad range for the natural frequencies between 80-240 rpm without the potential to define two groups separated by at least 70 rpm.

During operation, the rotation of the drum 16 can be accelerated to an intermediate speed above the first group 150, such as to about 130 rpm in one example, having a spring angle of 8.5 degrees and a stiffness of 5.7 Newtons per millimeter. The rotational speed of the drum 16 can remain at about 130 rpm providing the opportunity to satellize the clothing, mix treating chemistry into the clothing, provide for initial low speed water extraction, or determine parameters of the system such as motor torque, drum imbalance, load imbalance, imbalance magnitude, drum position, load position, inertia, or friction in non-limiting examples. After performing the desired function at the intermediate rotational speed, the drum 16 can be accelerated to a rotational speed greater than the second group 152. The accelerations through the first group 150 and the second group can be done quickly so as to avoid operating in the adverse speed ranges. For example, the rotational speed of the drum 16 can be increased quickly to about 130 rpm, avoiding any prolonged operation at the rotational speed of the first group 150. There, the laundry within the treating chamber 18 can be satellized and parameters of the washing machine 10 can be determined. After determining the parameters, the drum 16 can be accelerated by the motor 88 through the second group 152 to about 300 rpm, again avoiding any prolonged operation within that speed range. In this manner, the natural frequencies of both groups 150, 152 can be avoided during operation. Therefore, a complete cycle of operation can be completed at multiple rotational speeds while generally avoiding operation within the natural frequency groups 150, 152, minimizing the potential for drum 16 oscillation or resonance at those frequencies to generate wash unit displacement.

It should be understood that for FIGS. 4-6, the use of particular rpm rates, angles, and stiffness are exemplary, and can be greater or smaller values based on considerations such as drum size or weight.

Figure 7:
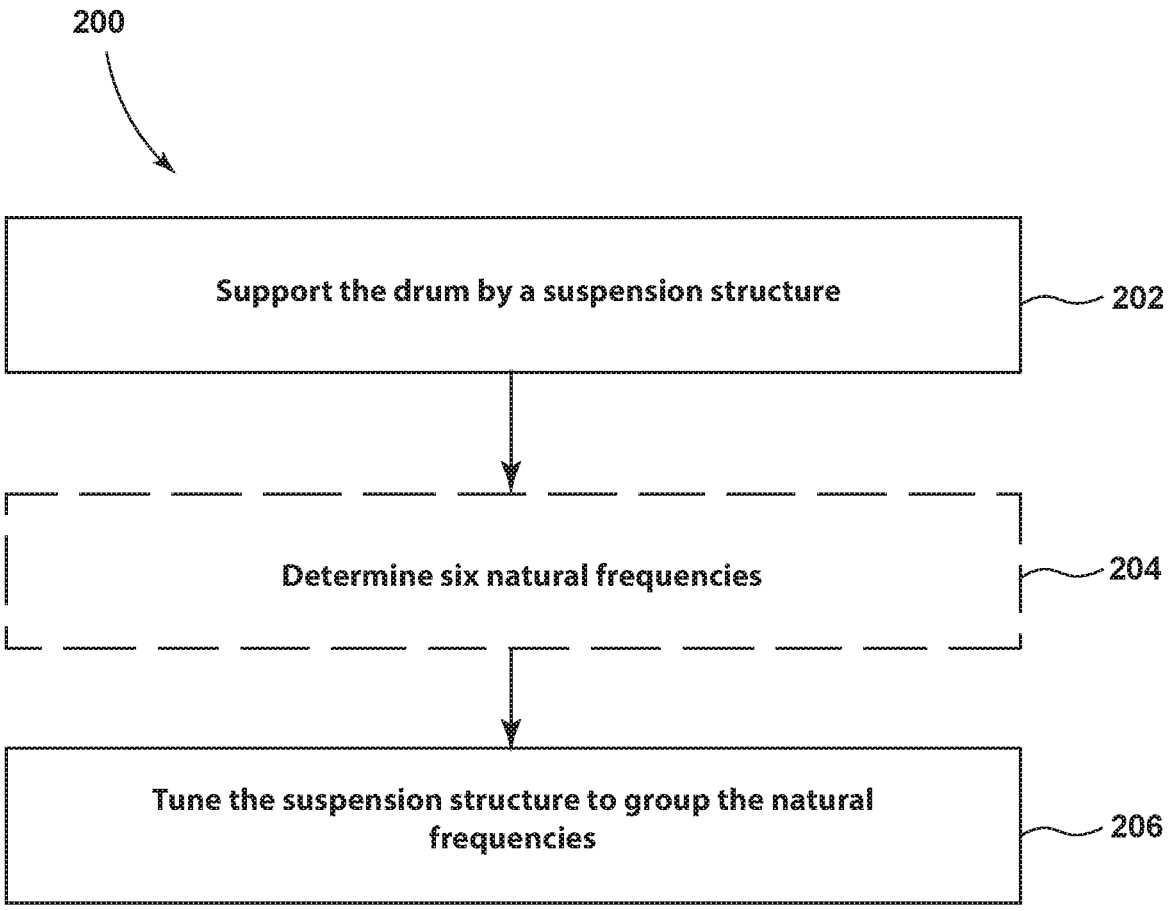
FIG. 7 is a flow chart illustrating a method of reducing displacement of a wash drum within the laundry treating appliance.

Turning now to FIG. 7, a flow chart illustrates a method 200 for reducing the displacement of a drum, such as the drum 16, rotatable around an axis of rotation 17. At 202, the drum 16 is supported by the suspension system 28, having multiple springs 30 suspending the drum 16 from the chassis 12. At 204, the six natural frequencies of the suspension system 28 can be determined. Step 204 is optional and the natural frequencies need not be determined in order to tune the suspension system 28. For example, the natural frequencies may already be known. The natural frequencies can be determined by standard methods known in the art, such as slow ramp testing with rubber weights and minimal system damping.

At 206, the suspension system 28 can be tuned to group the natural frequencies into ranges related to the rotational speed of the drum. As described above, tuning can be accomplished by varying the spring angle 118 or by changing the spring stiffness of the springs 30, using more or less springs 30, or changing the location or orientation of the springs 30, or use of a counterweight mass and positioning of such a counterweight. It is contemplated that the grouped natural frequencies will be separated by at least 70 rpm. The 70 rpm range provides for a broad enough range to avoid the natural frequencies of the suspension system 28 and enable washing machine operation between the groups of natural frequencies. It further provides cushion for accelerating and decelerating the rotation of the drum 16 without spending too much time within the frequency ranges for the groups of natural frequencies.

Figure 8:
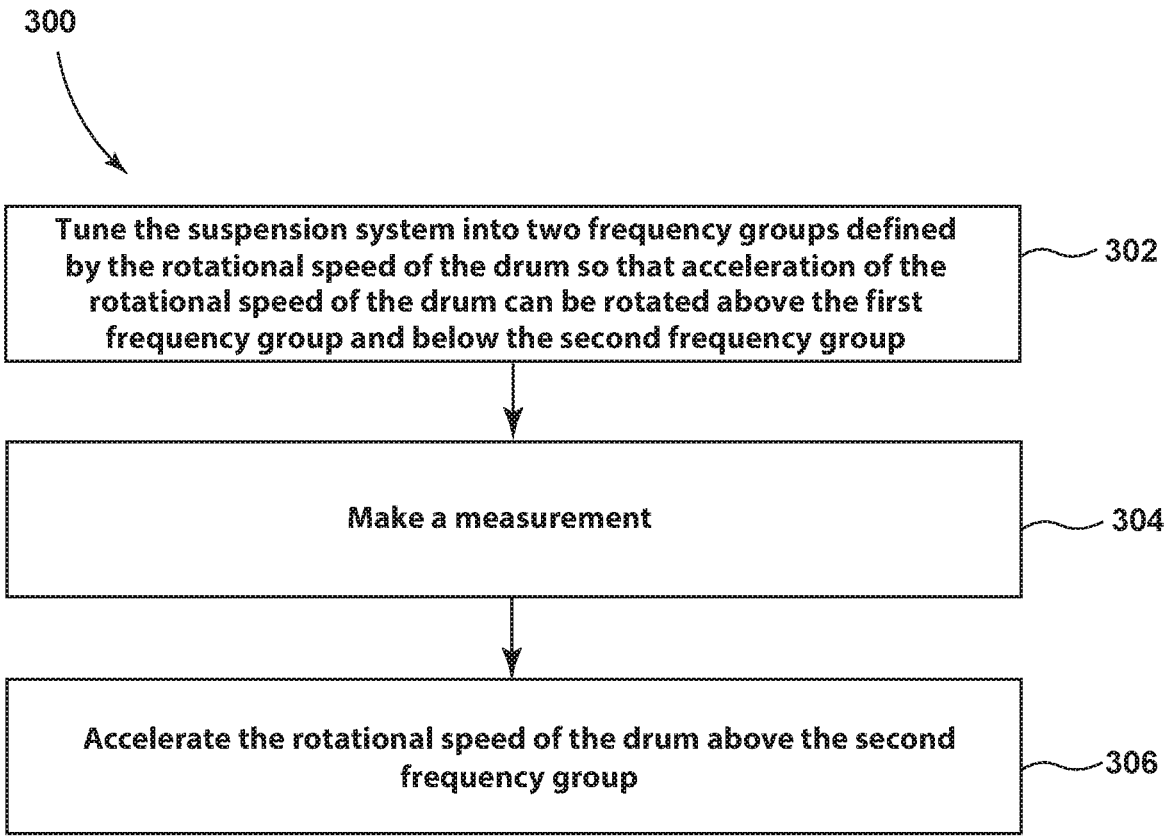
FIG. 8 is a flow chart illustrating a method of measuring laundry treating appliance parameters.

FIG. 8 illustrates a method 300 for measuring operational parameters of a laundry treating appliance such as the washing machine 10. At 302 the method 300 begins by tuning the suspension system 28 having six natural frequencies to group the frequencies into two groups defined by a rotational speed of the drum 16. Tuning can be accomplished by varying the spring angle 118 or by changing the spring stiffness of the springs 30, as well as changing the location or orientation of the springs 30, or use of a counterweight mass and positioning of such a counterweight. The groups are separated by at least 70 rpm. The tuned suspension system 28 permits rotation of the drum 16 to be accelerated above a first frequency defined by the first group 150, but below a second frequency defined by the second group 152. At 304, during rotation of the drum 16 between the two frequency groups 150, 152, a measurement or determination can be made of at least one of the appliance parameters. Appliance parameters can include, but are not limited to, motor torque, drum imbalance, load imbalance, imbalance magnitude, drum position, load position, load mass, inertia, or friction. After making one or more measurements of the parameters, at 306, the washing machine 10 is accelerated to a rotational speed above that of the second group 152. Utilizing this method 300, the natural frequencies can be tuned into two groups 150, 152, permitting rotational control of the drum 16 to avoid the natural frequencies of the suspension system 28, avoiding excessive wash unit displacement and any potential tub-chassis contact or 'walking' of the washing machine 10.

The present disclosure achieves a variety of benefits including that displacement of the drum 16, tub 14, or entire washing machine 10, caused by rotation of the drum at a natural frequency of the washing machine suspension system 28, can be minimized. Reducing or eliminating the potential for displacement also allows the tub to be placed closer to the chassis, which can in turn lead to the ability to increase the tub and the treating capacity for the washing machine. The present disclosure also allows the natural frequencies of the suspension system to be grouped without rotating the drum at one of the suspension system natural frequencies.

To the extent not already described, the different features and structures of the various embodiments can be used in combination with each other as desired. That one feature may not be illustrated in all of the embodiments is not meant to be construed that it cannot be, but is done for brevity of description. Thus, the various features of the different embodiments can be mixed and matched as desired to form new embodiments, whether or not the new embodiments are expressly described. All combinations or permutations of features described herein are covered by this disclosure.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance, comprising:

a structural support system;

a laundry holding system disposed within the structural support system, the laundry holding system including a rotatable treating chamber;

a motor operably coupled to the rotatable treating chamber;

a suspension system operably coupled to at least a portion of the laundry holding system and suspending the laundry holding system within the structural support system, the suspension system having six natural frequencies including three translational frequencies and three rotational frequencies, the suspension system includes at least one spring that is configured to group the three translational frequencies and three rotational frequencies into a first group determined by a predetermined first rotational speed range of the rotatable treating chamber or the motor and a second group determined by a predetermined second rotational speed range of the rotatable treating chamber or the motor that is separated from the predetermined first rotational speed range, in this manner the first group and the second group are correlated to known speeds that can be accelerated through during a cycle of operation; and a controller configured to accelerate the rotatable treating chamber, via the motor, to a rotational speed between the first group and the second group.

2. The laundry treating appliance of claim 1 wherein the structural support system comprises a housing defining an interior.

3. The laundry treating appliance of claim 1 wherein the laundry holding system comprises a tub.

4. The laundry treating appliance of claim 3 wherein the laundry holding system further comprises a rotatable drum provided within the tub and the rotatable drum defines the rotatable treating chamber.

5. The laundry treating appliance of claim 4 wherein the at least one spring includes multiple springs mounting the tub to the structural support system.

6. The laundry treating appliance of claim 4 wherein the controller is configured to determine operational parameters while the rotatable drum is rotated at the rotational speed between the first and second group.

7. The laundry treating appliance of claim 6 wherein the controller is configured to determine of at least one of a motor torque, a rotatable drum imbalance, a load imbalance, an imbalance magnitude, a rotatable drum position, a load position, a load mass, inertia, or friction.

8. The laundry treating appliance of claim 4 wherein an angle of the spring, a stiffness of the spring, a location of the spring, or an orientation of the spring configures the spring to group the three translational frequencies and three rotational frequencies.

9. The laundry treating appliance of claim 8, further comprising a counterweight mass operably coupled to one of the rotatable drum or the suspension system.

10. The laundry treating appliance of claim 1 wherein the first group and second group are separated by at least 70 rpm.

11. The laundry treating appliance of claim 1 wherein the first group comprises two translational frequencies and the second group comprises one translational frequency and three rotational frequencies.

12. The laundry treating appliance of claim 11 wherein the first group comprises natural frequencies between 70-105 rpm and the second group comprises natural frequencies between 170-260 rpm.

13. A method of reducing displacement of a rotatable treating chamber of the laundry treating appliance of claim 1, the method comprising:

supporting the laundry holding system including the rotatable treating chamber by the suspension system within a structural support system; and tuning the suspension system, the suspension system having six natural frequencies including three translational frequencies and three rotational frequencies, the suspension system includes at least one spring and wherein the tuning comprises adjusting the suspension system to group the three translational frequencies and the three rotational frequencies into a first group determined by a predetermined first rotational speed range of the rotatable treating chamber or the motor and a second group determined by a predetermined second rotational speed range of the rotatable treating chamber or the motor that is separated from the predetermined first rotational speed range by at least 70 rpm, the adjusting correlating the first group and the second group to known speeds that can be accelerated through during a cycle of operation.

14. The method of claim 13, further comprising determining the six natural frequencies of the suspension system.

15. The method of claim 14 wherein tuning the suspension system includes adjusting the suspension system to group two of the three translational frequencies within the predetermined first rotational speed range and one of the three translational frequencies and three of the rotational frequencies at the predetermined second rotational speed range.

16. The method of claim 13 wherein the predetermined first rotational speed range is between 70-105 rpm and the predetermined second rotational speed range is between 170-260 rpm.

17. The method of claim 13, further comprising operating the motor between the predetermined first rotational speed range and the predetermined second rotational speed range and determining at least one parameter of the laundry treating appliance during the operating.

18. The method of claim 17 wherein determining the at least one parameter comprises determining at least one of motor torque, motor power, rotatable treating chamber imbalance, load imbalance, imbalance magnitude, rotatable treating chamber position, imbalance axial position, imbalance type, load mass, inertia, load imbalance angular position, motion, and friction.

19. The method of claim 13 wherein tuning the suspension system further comprises adjusting at least one of a stiffness or an angle of a portion of the suspension system.

20. The method of claim 19 wherein tuning the suspension system comprises adjusting both the stiffness and the angle of the spring of the suspension system.

* * * * *